United States Patent [19]

Buckner

[11] Patent Number: 4,694,820

[45] Date of Patent: Sep. 22, 1987

[54] STOVE WITH CATALYTIC CONVERTER

[76] Inventor: Carrol E. Buckner, 5 Piney Dr., Fletcher, N.C. 28732

[21] Appl. No.: 941,358

[22] Filed: Dec. 15, 1986

[51] Int. Cl.[4] ..... F23V 15/00; F23L 11/00

[52] U.S. Cl. ..... 126/289; 126/285 A; 126/77; 110/210; 110/214; 422/177

[58] Field of Search ..... 126/289, 285 R, 290, 126/285 A, 292, 75, 83, 77, 286, 112; 110/203, 214, 210, 211; 422/177, 176, 181, 180; 55/DIG. 30, 307, 422

[56] References Cited

U.S. PATENT DOCUMENTS

| | | | |
|---|---|---|---|
| 4,207,861 | 6/1980 | Buckner | 126/77 |
| 4,319,556 | 3/1982 | Schwartz et al. | 126/77 |
| 4,345,528 | 8/1982 | Allaire et al. | 110/203 |
| 4,373,507 | 2/1983 | Schwartz et al. | 110/203 |
| 4,448,185 | 5/1984 | Buckner et al. | 126/77 |
| 4,466,421 | 8/1984 | Dorsch et al. | 126/77 |
| 4,479,921 | 10/1984 | Allaire et al. | 126/77 |
| 4,502,395 | 3/1985 | Barnett | 126/77 |
| 4,549,524 | 10/1985 | Albertsen et al. | 126/289 |
| 4,582,045 | 4/1986 | Dorau et al. | 110/203 |

*Primary Examiner*—James C. Yeung

*Attorney, Agent, or Firm*—Leitner, Greene & Christensen

[57] ABSTRACT

A solid fuel burning stove having a catalytic converter apparatus located above the stove combustion site. The apparatus includes a horizontal partition having a first opening in direct communication with the stove flue and a second opening adjacent catalytic elements. A by-pass damper is slideable on the partition to open and close the first opening. The by-pass damper is connected via a hollow rod to a handle located at the front of the stove. Exit ports are located in the hollow rod to provide supplemental heated air to the catalytic elements.

8 Claims, 5 Drawing Figures

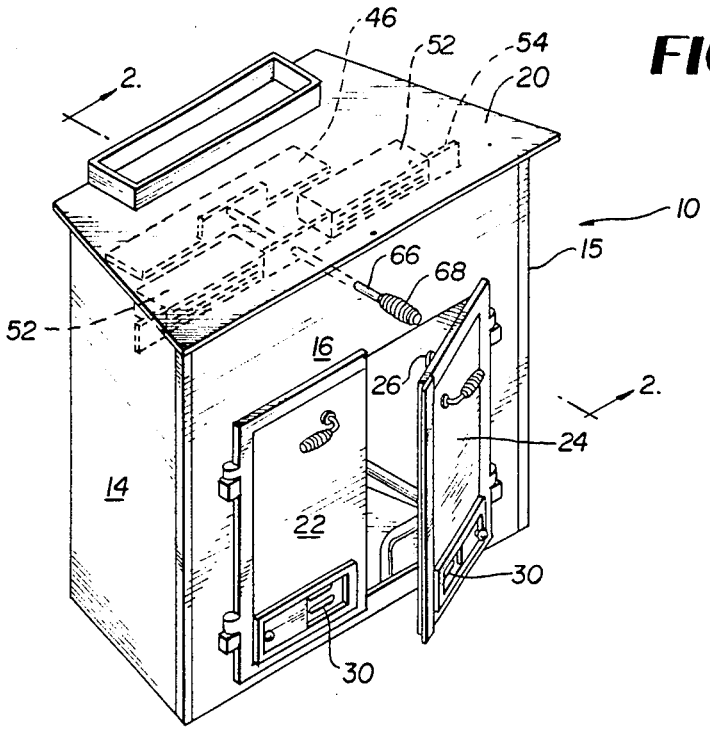
FIG. 1
FIG. 2A
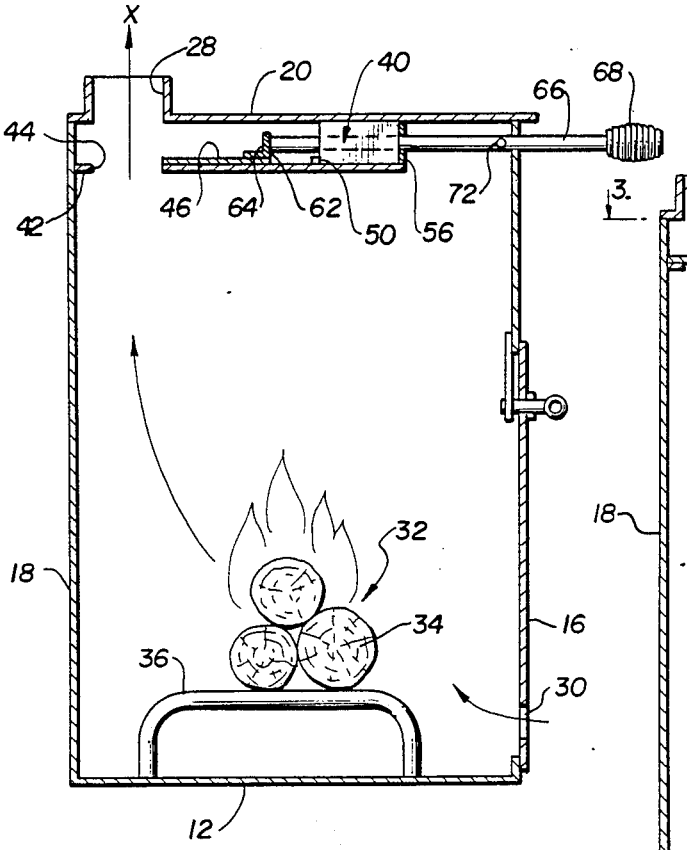
FIG. 2B
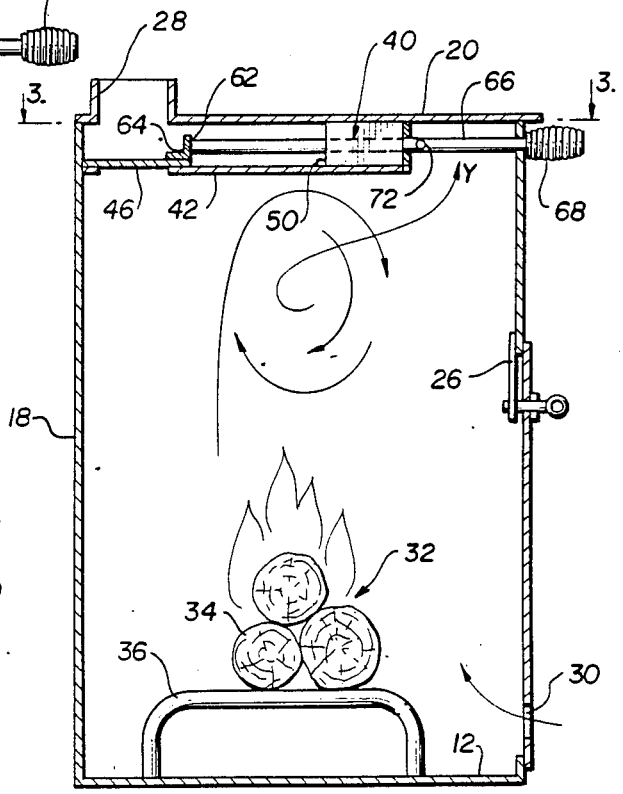

STOVE WITH CATALYTIC CONVERTER

BACKGROUND OF THE INVENTION

This invention relates to stoves or furnaces used as heating units, and specifically, to stoves provided with a catalytic converter for treating the effluent gases produced by combustion.

With the energy crises and the increase in expense of fuel, people have become preoccupied in maximizing the use of inexpensive fuels. One particularly available, inexpensive and replenishable fuel is wood and wood by-products. Increasingly, this source of fuel has been taken advantage of by the use of wood burning stoves and furnaces to employ the heat release by combustion as a supplement or replacement for conventional domestic and small commercial heating systems.

Generally, the heat is transferred to the room by radiation from the surface of the stove wall or, more practically, through a forced air system, employing one or more channels surrounding the walls of the stove as a heat exchange means. A stove of the latter type is disclosed in Buckner et al. U.S. Pat. No. 4,301,783.

The combustion of wood and similar fuels produces effluent gases rich in creosote and similar hydrocarbon pollutants, which are potentially harmful when released to the atmosphere. The same pollutants present serious dangers of chimney and house fires when deposited on the walls of flues and chimneys as the effluent gases pass therethrough. The use of wood burning stoves has grown so prevalent in many states that governmental authorities are taking steps to require that all such heating units be provided with effluent gas treatment means for controlling the level of pollutants that are expelled. In any event, even in the absence of such legislation, keeping pollution to a minimum is an obviously desirable goal.

The use of a catalytic converter as an effluent gas treatment means is becoming increasingly common in wood stoves. Patents disclosing such usage include U.S. Pat. Nos. 4,319,556 and 4,373,507. However, the use of a catalytic converter in a wood stove is not a simple matter and a considerable number of obstacles must be overcome for the converter to work properly.

As illustrated in U.S. Pat. Nos. 4,319,556 and 4,373,507, the catalyst is conventionally placed directly over the combustion site of the heating stove. When the flames of the fire grow to a maximum, the problem of flame impingement directly on the catalyst may severely reduce the effective life and efficiency of the catalytic converter. At the same time, location of the catalytic converter in direct communication with the combustion site results in a substantial amount of particulate matters, largely ash, being deposited upon the catalytic surface of the converter, again severely decreasing both the life and efficiency of the catalytic converter.

The presence of the catalytic converter, combined with the need to replenish the fuel supply, has also presented problems when using the existing systems. Generally, to replenish the fuel supply, a door opening on the combustion site is opened and the solid fuel added to the combustion site. Of course, the effluent gas is constantly being generated, even while fuel is being added to the fire. The presence of a catalytic converter creates a substantial back pressure, such that, when the door to the combustion site is opened, the produced smoke tends to escape into the room being heated, which is substantial annoyance and a safety hazard.

At the same time, the opening of the door allows the relatively cooler air of the surrounding areas to rush into the combustion site area. In conventional systems, the catalytic converter is in direct communication with this area and the colder room air impacts directly on the converter surface. This substantially drops the temperature of the converter to a point where it is no longer operative rendering the converter substantially useless until the heat from the fire reheats the converter. During this time, which is generally quite longer than the time necessary to add fuel to the fire, any effluent gas passing through the convertter will be to the air pollution.

To avoid the aforementioned problems, it has been proposed to locate the catalytic converter away from direct contact with the combustion site. In U.S. Pat. No. 4,345,528, there is disclosed the placement of the converter in the flue of the stove. However, it has been found that the remote placement of the catalytic converter can cause oxygen starvation in the converter thereby reducing the converter's efficiency. The remote placement of the converter also presents problems in removing the catalytic converter for service and/or replacement.

Thus, there exists a need for a wood burning stove with a catalytic converter that can overcome all of the aforementioned problems and also provide sufficient oxygen flow to the converter.

Accordingly, it is one object of this invention to provide a catalytic converter apparatus for solid fuel stoves which will overcome all of the above-described problems.

It is another object of this invention to provide a catalytic converter apparatus which is not subject to flame impingement and is not cooled when the stove door is opened.

It is another object of this invention to provide a catalytic converter apparatus which is not subjected to the deposition of particulate matters on its catalytic surfaces.

Still another object of this invention is to provide an a catalytic converter apparatus which does not cause smoke to fill the room to be heated when the stove door is opened.

Yet another object of this invention is to provide a supplemental air flow to the catalytic converter to allow the converter to operate at peak efficiency.

Still another object of this invention is to provide a catalytic converter apparatus in which the catalytic elements can be readily replaced.

It is still yet another object of this invention to provide a solid fuel stove useful as a heater which includes an effluent gas treatment apparatus enjoying all of the above-described advantages.

SUMMARY OF THE INVENTION

The above outlined objectives as well as other objects and features of the present invention are accomplished by a solid fuel burning stove having a catalytic converter apparatus located above the stove combustion site. The apparatus includes a horizontal partition which blocks direct flame impingement on the catalytic elements supported on the partition. The partition extends from the back of the stove to a point spaced from the stove front to provide an opening through which the effluent gases may enter to pass through the catalytic elements and then out the stove flue. The partition includes a second opening directly in flow communication with the stove flue and a by-pass damper is slideable on the partition to open and close the second opening thus controlling the flow of the effluent gas through the catalytic elements. The by-pass damper is connected via a rod means having a center bore or duct to a handle located at the front of the stove. Exit ports are located in the rod means in communication with the duct such that when the by-pass damper has closed the second opening, the ports are adjacent the catalytic elements to provide supplemental heated air thereto.

BRIEF DESCRIPTION OF THE DRAWINGS

For a full understanding of the nature and objects of the invention, reference should be made to the following detailed descriptions taken in conjunction with the accompanying drawings in which:

FIG. 1 is a partial diagrammatic perspective view showing a solid fuel burning stove having a catalytic converter apparatus in accordance with the invention;

FIG. 2A is a vertical sectional view taken along line 2—2 of FIG. 1 showing the by-pass damper in open position;

FIG. 2B is a vertical sectional view taken along line 2—2 of FIG. 1 showing the by-pass damper in closed position;

DESCRIPTION OF THE PREFERRED EMBODIMENT

Figure 3A:
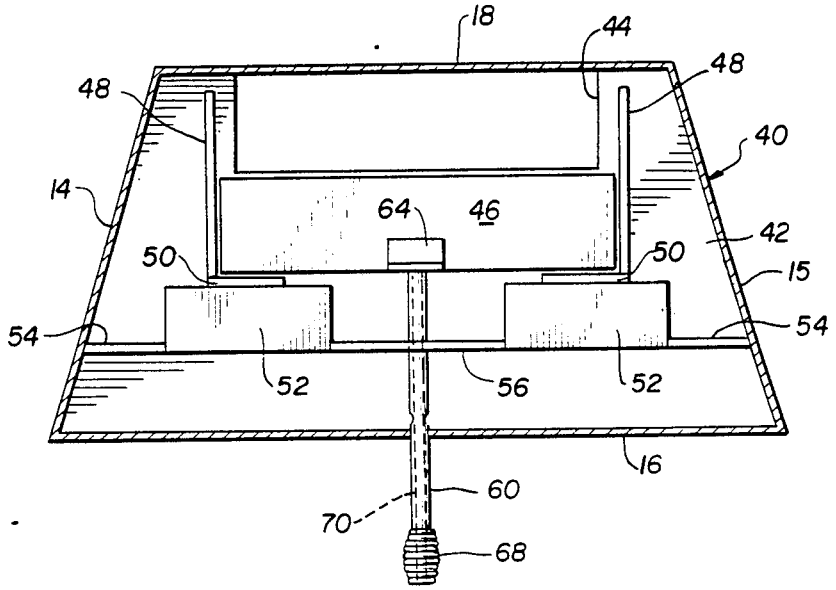
FIG. 3A is a plan view taken along line 3—3 of FIG. 2 showing the by-pass damper in open position.

Referring now to the drawings in detail, where like reference numerals indicate like parts throughout the several figures, reference numeral 10 indicates the solid fuel burning stove of the present invention generally comprised of a floor 12, side walls 14, 15, a front wall 16, a rear wall 18, and a top wall 20. These components enclose the fire box of the conventional solid fuel burning stove. The front wall 16 includes a pair of doors 22, 24 with one of the doors having a typical rotating latch plate 26 that may be rotated behind front wall 16 to hold both doors tightly closed. The top wall 20 has the usual exit port or flue 28 through which the effluent gas from the burning fuel exits the stove. As is well known, the flue 28 may be connected to chimney pipe (not shown) or the stove may be placed directly into a fireplace so that the effluent gas exiting through the flue 28 will flow directly into the fireplace chimney. As is also conventional, the doors may have vent means 30 through which air may be drawn into combustion site 32 as shown in FIGS. 2A, 2B comprising the area surrounding the fuel, such as logs 34, resting on andirons 36. In the conventional stove and in one phase of the present invention, the effluent gas from combustion site 32 will directly exit through flue 28 as shown by arrow X in FIG. 2A.

Figure 3B:
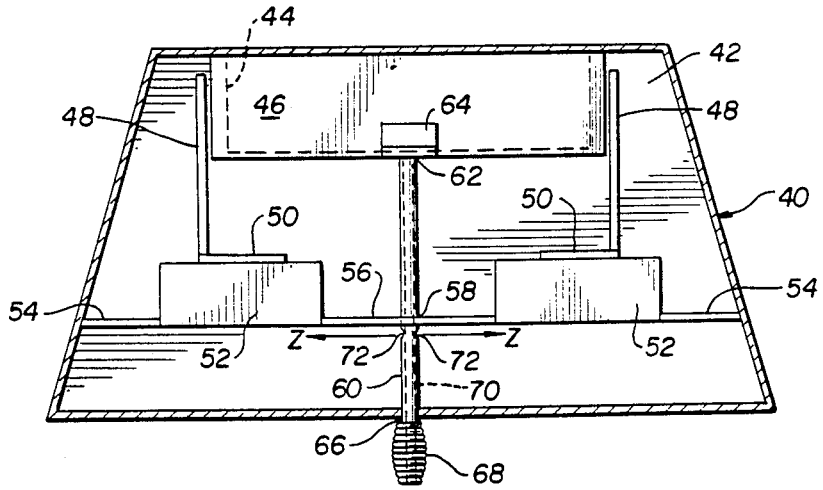
FIG. 3B is a plan view taken along line 3—3 of FIG. 2 showing the by-pass damper in closed position.

The stove 10 of the present invention is provided with a catalytic converter apparatus generally referred to by reference numeral 40. The apparatus 40 comprises a horizontal partition 42 having an opening 44 substantially in alignment with flue 28. The opening 44 may be selectively opened or closed, and when opened, provides direct communication between flue 28 and combustion site 32. A by-pass damper plate 46 is adapted to slide on partition 42 from a first open position as seen in FIGS. 2A, 3A to a second closed position as seen in FIGS. 2B, 3B where the damper plate 46 covers opening 44 thereby blocking direct communication between flue 28 and combustion site 32. The damper plate 46 slides between guide elements 48 which may be strips of metal suitably attached, such as by welding to partition 42. Similar strips of metal are used to form stop elements 50 to halt the opening movement of damper plate 46 and in addition, the stop elements 50 are used to provide a rearmost point for catalytic elements 52 that rest on partition 42 at the front thereof. As seen in the drawings, two separate catalytic elements are shown, however, it should be obvious that different sizes and shapes of the catalytic elements may be used. The catalytic elements 52 may be of any type known to those of ordinary skill in the art suitable for catalyzing the combustion of the effluent gasses from wood and similar fuels, typically operating at a minimum temperature of about 500° F. One exemplary, but not necessarily preferred, catalytic element is available from Corning Glass Works, and is identified as the Corning Catalytic Combustor. Essentially, such elements bear on the surfaces of through holes provided therein, a catalyst, generally a noble metal, which substantially lowers the "burning" temperature of the effluent gas from a wood fire, igniting and completely burning the cresote and hydrocarbon impurities of the effluent gas.

End plates 54 attached to the front of partition 42 are provided to seal the space between the catalytic elements 52 and the stove side walls 14, 15. A central plate 56 also attached to the front of partition 42 having an opening 58 therein is also provided to act as a support for rod 60 as well as to seal the space between the catalytic elements. The rod 60 is connected at an end 62 to damper plate 46 by being suitably attached such as by welding to L-shaped plate 64 affixed to damper plate 46. The other end 66 of rod 60 extends outwardly from front wall 16 and a handle element 68 is affixed thereon for gripping by a user to move rod 60 and damper plate 46 between open and closed positions. The rod 60 has a center bore or duct 70 and is open at the end supporting handle element 68. The handle element 68 must not block duct 70 and preferably the handle element 68 is formed of a coiled wire wound in a substantially open configuration to allow air to circulate thru keeping the handle element 68 relatively cool compared to the rod 60. A clear epoxy coating may be placed on the coils to further reduce the conduction of heat from rod 60 to the handle elements. Air flowing into duct 70 will also provide cooling for the handle element 68.

The provision of the duct 70 in the rod 60 is an important provision of the invention. Diametrically opposed openings or exit ports 72 are formed in rod 60 to be in fluidic communication with duct 70. The ports 72 are formed in a horizontal plane containing the longitudinal axis of rod 60 and they are located on the rod 60 slightly forward of center plate 56 when the damper plate 46 is in closed position. Air flowing through duct 70, due to the reduced pressure in the stove, will exit through opposed ports 72 in a horizontal direction as shown by arrows Z in FIG. 3B. The exiting air will mix with the effluent gas Y entering the catalytic elements 52 thereby providing additional oxygen to the catalytic process. The air as it moves through duct 70 to ports 72 will be heated by the heat within the stove thus avoiding any cool down of the catalytic elements.

The horizontal partition 42 is spaced from the top wall 20 to enable the catalytic elements 52 to be of sufficient size to properly accommodate and act on the effluent gas Y that will enter the catalytic converter apparatus 40. It has been found that the apparatus 40 performs properly with each catalytic element 52 being 2 inches in height, 2 inches in depth and 7 inches wide. Accordingly, the horizontal partition 42 would be located from the top wall a distance just slightly greater than the height of the catalytic elements 52 to permit the elements 52 to be readily positioned. To prevent any flow of the effluent gas over the catalytic elements 52 or the plates 54, 56, a gasket (not shown) may be affixed to the inside of the top wall to seal off any open space. The partition 42 is preferably connected such as by welding to the rear wall 18 and to the side walls 14, 15. The partition 42 extends from the rear wall 18 to a position spaced from front wall 16 to form an opening of sufficient dimension to permit free flow of gas Y into the catalytic elements 52. It has been found that in a stove having a dimension of 18½ inches from the rear wall 18 to front wall 16, an opening of 7 inches between the end of partition 42 and front wall 16 provides sufficient access to the catalytic elements 52.

From the preceding description, it should be evident that the objects of the invention are obtained. When the fire is being started or when fuel is being replenished, the damper plate 46 is moved to the open position thereby permitting the effluent gas to bypass the catalytic converter apparatus 40 thus preventing the gas exiting through the open doors. The location of the catalytic elements on partition 42 prevents flame impingement but the direct heating of partition 42 by the fire and the gases will maintain the proper temperature of the catalytic elements. Also, as shown by the arrows in FIG. 2B, the partition 42 will cause a rolling motion of the effluent gases above the combustion site which not only causes re-burning of the effluent gases but the slightly turbulent motion will cause the heavier ash particles to drop from the effluent gas just prior to the gas Y entering the catalytic elements thus avoiding the problem of deposits on the catalytic elements. The location of the catalytic elements just a few inches below the top will prevent colder room air impacting directly on the elements when the doors are opened. Finally, the provision of preheated room air through the rod 60 prevents oxygen starvation of the catalytic elements.

Although the invention is described and illustrated in detail, it is to be clearly understood that the same is by way of illustration and example only and is not to be taken by way of limitation. The spirit and scope of the invention is to be limited only by the terms of the appended claims.

What is claimed is:

1. A solid fuel burning stove having a combustion chamber defined by a top wall, a bottom wall, a front wall, a rear wall and a pair of side walls, a flue in communication with said combustion chamber for removing exhaust gases and a catalytic converter apparatus within said combustion chamber; said catalytic converter apparatus comprising:

support means for supporting catalytic elements and having first and second inlet means, each in communication with the combustion chamber and flue;

a damper means slideably mounted on said support means for movement between open and closed positions with said first inlet means for opening and closing the same, and elongated conduit means partially in said combustion chamber having one end coupled to the damper means and a second end remote from said one end extending outside the combustion chamber and having a handle means affixed thereon, said conduit means having an air inlet means outside the combustion chamber and an air outlet means inside thereof, and an intermediate flow channel connecting said air inlet mean to said air outlet mean for allowing the passage of outside air therethrough, said conduit means operative when activated by the user on said handle means for moving said damper means between the respective open and closed positions and for communicating outside air into the combustion chamber proximate the catalytic elements when the damper is in the closed position, whereby the catalytic elements receive outside air for enhanced combustion of the exhaust gases passing therethrough when said damper means is in the closed position.

2. The solid fuel burning stove as set forth in claim 1 wherein said conduit means is in heat exchange relation with the combustion chamber and the outside air is preheated while flowing therethrough.

3. The solid fuel burning stove as set forth in claim 2 where said support means is a horizontal partition affixed to said side walls extending from said rear wall toward said front wall and spaced therefrom to define said second inlet means, said catalytic elements being located on said partition proximate said second inlet means, said partition being spaced from said top wall a distance substantially equal to the height of said catalytic elements.

4. The solid fuel burning stove as set forth in claim 3 wherein said first inlet means is an opening in said partition, said opening being located in substantial vertical alignment with said flue means, said damper means including a horizontal plate slideable on said partition to cover said opening and thereby close said first inlet means.

5. The solid fuel burning stove as set forth in claim 4 wherein said conduit means is a tubular rod having a duct therein, said air outlet means being a pair of diametrically opposed openings extending through said rod to said duct.

6. The solid fuel burning stove as set forth in claim 5 wherein said diametrically opposed openings are placed along said longitudinal axis of said rod such that said openings are proximate said catalytic elements when said damper means is in its closed position.

7. The solid fuel burning stove as set forth in claim 6 wherein said air inlet means is an opening at one end of said rod in flow communication with said duct, said handle means being a wire coiled around said one end of said rod.

8. The solid fuel burning stove as set forth in claim 7 wherein said wire is coiled into substantially an ellipsoid.

* * * * *